US005781169A

United States Patent [19]

Kuijk et al.

[11] Patent Number: 5,781,169

[45] Date of Patent: Jul. 14, 1998

[54] ELECTROLOMINESCENT DISPLAY DEVICE WITH SEMICONDUCTING POLYMER

[75] Inventors: Karel E. Kuijk; Ronald R. Drenten, both of Eindhoven, Netherlands

[73] Assignee: U.S. Philips Corporation, New York, N.Y.

[21] Appl. No.: 741,135

[22] Filed: Oct. 31, 1996

[30] Foreign Application Priority Data

Nov. 2, 1995 [EP] European Pat. Off. ..... 95202952

[51] Int. Cl.[6] ..... G09G 3/32

[52] U.S. Cl. ..... 345/82; 345/76

[58] Field of Search ..... 345/82, 83, 76, 345/77; 348/800, 801, 802, 803, 792, 793

[56] References Cited

U.S. PATENT DOCUMENTS

| | | | |
|---|---|---|---|
| 3,843,959 | 10/1974 | Owaki et al. | 348/803 |
| 3,909,788 | 9/1975 | Kaelin et al. | 348/802 |
| 4,635,127 | 1/1987 | Togashi | 348/800 |
| 5,010,411 | 4/1991 | Shimada et al. | 348/803 |
| 5,563,424 | 10/1996 | Yang et al. | 257/40 |

OTHER PUBLICATIONS

Article by D. Braun and A. J. Heeger in Applied Physics Letters (18), pp. 1982–1984 (6 May 1991).

*Primary Examiner*—Xiao Wu
*Attorney, Agent, or Firm*—John C. Fox

[57] ABSTRACT

A drive of a display device based on polymer LEDs, for example pixels arranged in the form of a matrix, in which the lifetime is increased by writing the information from an interlaced signal each time into two successive rows. The driving may be based on voltage control at which voltages across the pixels define the picture to be displayed, but may alternatively be based on current control.

2 Claims, 3 Drawing Sheets

ELECTROLOMINESCENT DISPLAY DEVICE WITH SEMICONDUCTING POLYMER

BACKGROUND OF THE INVENTION

The invention relates to an electroluminescent device comprising at least one layer of a semiconducting conjugated polymer, which layer is present between a first and a second pattern of electrodes, at least one of which patterns is transparent to light to be emitted, and a first pattern comprises a material which is suitable for injecting holes or electrons in the layer.

The layer may comprise a single light-emitting (emissive) polymer layer, but also a plurality of layers, for example a layer for injecting holes and a light-emitting emissive layer. A packet of more than two layers is alternatively possible.

The polymer layer and the two electrode layers may jointly constitute a plurality of LEDs, for example, in the form of a matrix of light-emitting surfaces as intended for a display. The operation of such structures is based on the recombination of electrons and holes which are injected in the semiconductor material from electrodes located at both sides of the layer. Due to these recombinations, energy is released in the form of (visible) light, a phenomenon which is referred to as electroluminescence. The wavelength and hence the color of the emitted light is determined by the bandgap of the semiconductor material.

The use of semiconducting organic polymers as proposed in an article by D. Braun and A. J. Heeger in Applied Physics Letters 58 (18), pp. 1982–1984 (6 May 1991) increases the number of possible materials for use in these types of devices. Semiconducting organic polymers have a conjugated polymer chain. The bandgap, the electron affinity and the ionization potential can be adjusted by suitable choice of the conjugated polymer chain and by the choice of suitable side chains. In contrast to electrically conducting polymers, these conjugated polymers are undoped. A layer of such a polymer material can be manufactured by means of a CVD process, but is preferably manufactured by means of spin coating of a solution of a soluble conjugated polymer. With these processes, LEDs and displays having a large light-emitting surface can be manufactured in a simple manner.

Matrix displays for displaying information, for example for video applications, and monitors are divided into a large number of pixels arranged in rows and columns. Problems usually occur, notably when driving these types of matrix displays. For example, the individual pixels emit light for a short period. To achieve a desired time average luminance, a driven pixel must convey a large current for a short selection period. A too high current density is, however, detrimental to the lifetime of such LED structures.

OBJECTS AND SUMMARY OF THE INVENTION

It is an object of the invention to obviate the above-mentioned drawback. To this end, an electroluminescent device according to the invention is characterized in that the electrodes constitute crossing patterns of row and column electrodes, while pixels are defined at overlap areas in the interpositioned polymer, layer and the device comprises a drive circuit which presents drive voltages derived from picture information from a line of a first odd field to two successive rows of pixels, and drive voltages derived from picture information from a line of a second even field to two successive rows of pixels, and drive voltages derived from picture information from the first and the second field are alternately presented to each row of pixels.

The invention is based on the recognition that, for achieving the same (time-)averaged luminance, the individual pixels need to have only half the luminance as compared with the situation in which only information from one of the two fields is presented to each row of pixels. The required current density is then considerably lower. Although the pixels are now driven at the double frequency, the lifetime is increased. When the current density remains the same, the luminance can be approximately doubled.

These and other aspects of the invention will be apparent from and elucidated with reference to the embodiments described hereinafter.

BRIEF DESCRIPTION OF THE DRAWINGS

In the drawings:

FIG. 2 is a diagrammatic cross-section taken on the line II—II in FIG. 1, while

The Figures are diagrammatic and not to scale corresponding elements usually have the same reference numerals.

DESCRIPTION OF THE PREFERRED EMBODIMENTS

Figure 1:
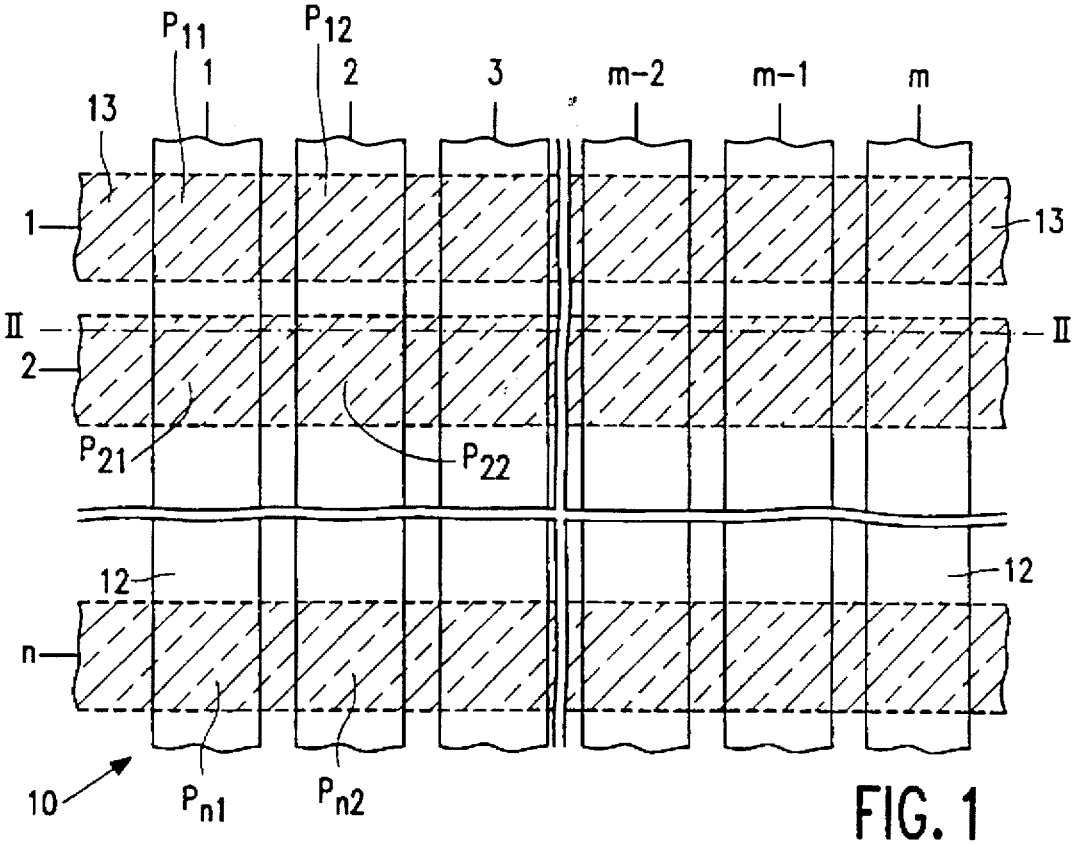
FIG. 1 is a diagrammatic plan view of a part of a display device according to the invention.
Figure 2:
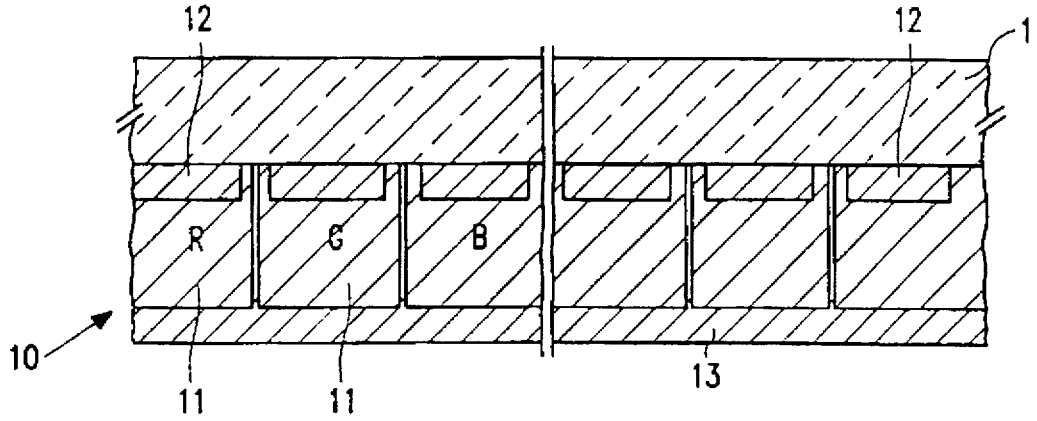

FIG. 1 is a plan view and FIG. 2 is a cross-section of a part of a display device 10 with a polymer layer 11 (or a packet of layers) between two patterns 12, 13 of electrode layers of electrically conducting materials. In this embodiment, the electrodes 12 constitute column or data electrodes, whereas the electrodes 13 constitute row or selection electrodes. In this way, a matrix of light-emitting diodes (LEDs) $P_{ij}$ is formed with the interpositioned emissive material, which LEDs are also referred to as pixels 14 (see FIG. 3) in this Application. At least one of the electrode patterns is transparent to the emitted light. The column or data electrodes 12 are driven during operation in such a way that they have a sufficiently positive voltage with respect to the selection electrodes 13 for the injection of holes in the active layer. The material of these electrodes 12 has a high work function and is generally constituted by a layer of indium oxide or indium-tin oxide (ITO). Particularly ITO is suitable due to its satisfactory electrical conductivity and high transparency. The selection electrodes 13 serve as negative electrodes (with respect to the electrodes 12) for the injection of electrons in the active layer. The material for this layer is aluminum in this embodiment. A material having a low work function, for example indium, calcium, barium or magnesium is preferably chosen. Since larger currents usually flow through the row electrodes, these are low-ohmic, for example, because of the choice of the material or the choice of the layer thickness, or by using an assembly of electrically conducting layers.

The ITO electrodes 12 are provided on a transparent substrate 1 by means of vapor deposition, sputtering or a CVD process. These electrodes and frequently also the electrodes 13 are patterned by means of a conventional photolithographic process or by means of partial shielding with a mask during the vapor deposition process, in conformity with the desired pattern for the device 10.

Suitable conjugated polymers for use in the active or emissive layer 11 are polymers based on poly(3-alkylthiophene) and poly(p-phenylene vinylene) (PPV). Soluble conjugated polymers are preferably used because they can easily be processed in, for example a spin coating process.

The layer 11 may be unstructured, for example, by using a single type of PPV derivate (monochrome display device), but alternatively strips of different compositions emitting mutually different colors may be provided, for example, by means of a photolithographic process. In the present embodiment, juxtaposed columns of color pixels $11^a$, $11^b$, $11^c$ emitting red, green and blue light, respectively, (FIG. 2) are chosen. The columns are obtained by providing separate strips of emissive material, denoted by R, G, B in FIG. 2, in the column direction.

The conjugated polymer layer usually has a thickness of between 10 and 250 nm, particularly between 100 and 200 nm.

Although this layer is shown as a single layer 11 in this embodiment, it may consist of a plurality of sub-layers in practice, for example, layers which ensure or enhance the injection of holes, and light-emitting or emissive layers.

The LED structure may be provided on a substrate consisting of, for example glass, quartz glass, ceramic or synthetic material. A light-transmissive or transparent substrate is preferably used. If a flexible electroluminescent device is desired, a transparent foil of synthetic material is used. Suitable transparent and flexible synthetic materials are, for example, polyimide, polyethylene terephtalate, polycarbonate, polyethene and polyvinyl chloride.

Figure 3:
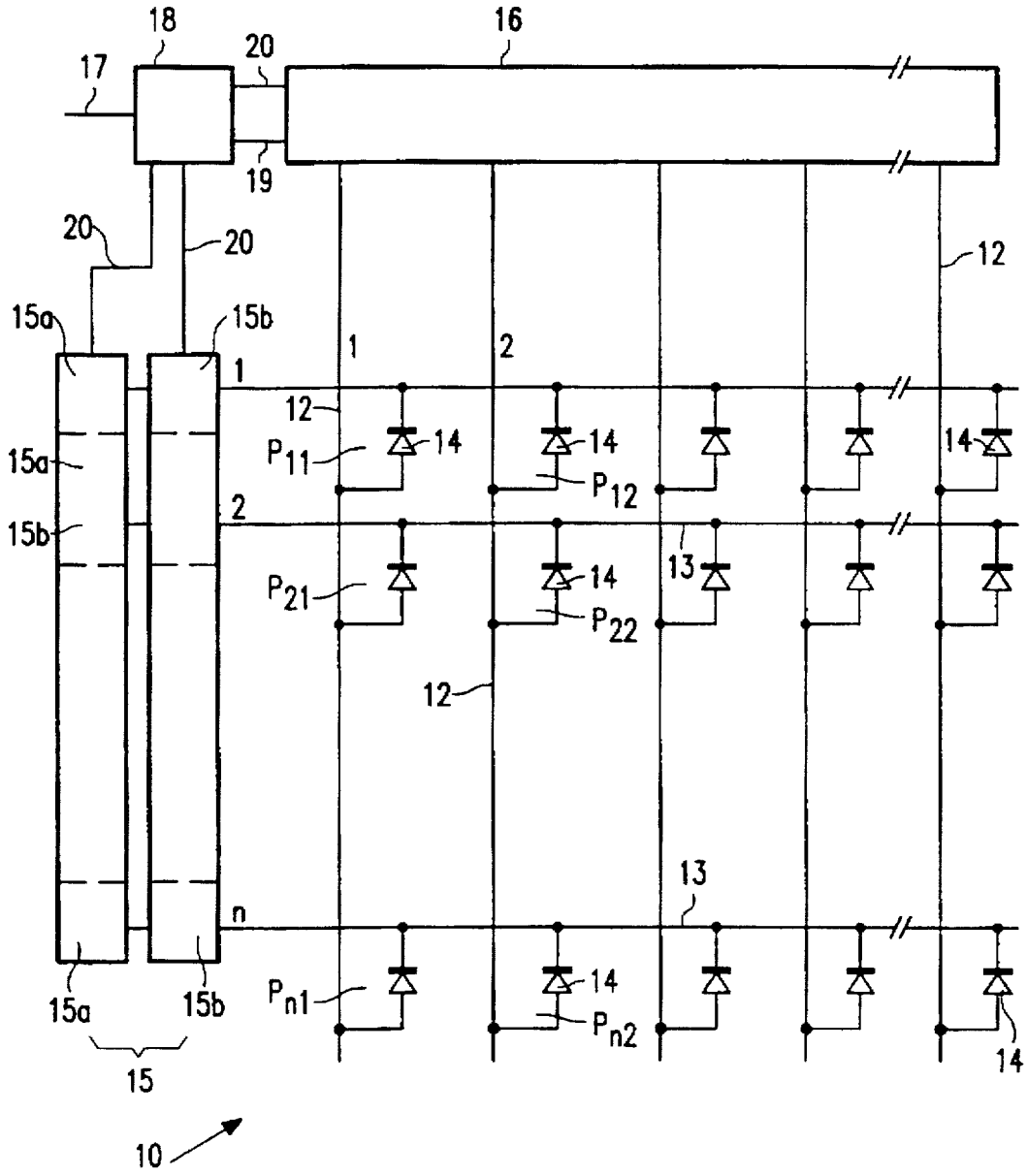
FIG. 3 shows diagrammatically an equivalent circuit diagram of a display device according to the invention.

FIG. 3 shows diagrammatically an equivalent circuit diagram of a part of a display device based on such pixels or LEDs 14 with n rows and m columns. This device further comprises a row selection circuit 15 and a data register 16. Externally presented information 17, for example a video signal, is processed in a processing unit 18 which, dependent on the information to be displayed, charges the separate parts of the data register 16 via supply lines 19, so that the column electrodes 12 are provided with data voltages. The relevant row selection voltages are presented by the row selection circuit 15. Mutual synchronization between the selection of the rows and the presentation of data voltages to the columns 12 is realized by means of the control unit 18 via control lines 20.

Figures 4, 5, 6, 7:
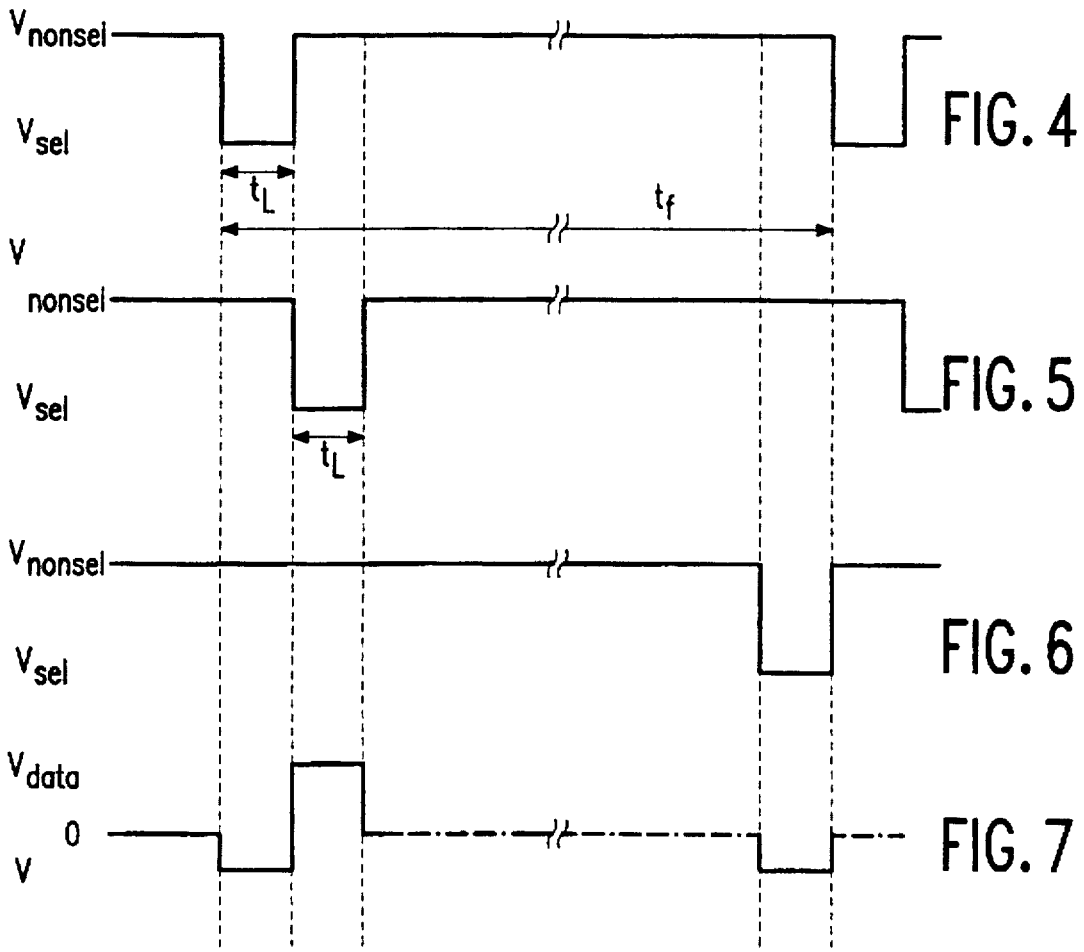
FIGS. 4 to 7 show drive signals for such a device.

The associated control signals for such a device are shown diagrammatically in FIGS. 4 to 7. FIGS. 4 to 6 represent the row selection signals which select the (pairs of) rows (1), (2,3), (4,5), (6,7), . . . during a first (odd) field period and during a selection period $t_L$ by presenting a selection voltage $V_{sel}$, and the pairs of rows (1,2), (3,4), (5,6), . . . during a second (even) field period. In the remaining period, which is equal to the field period $t_f$ reduced by $t_L$, a non-selection voltage $V_{nonsel}$, is presented. During the selection period $t_L$, the picture information is presented to the column or data electrodes 12, so that the pixels emit light of the desired intensity. The data voltages are shown in FIG. 7 for an arbitrary column electrode 12.

To this end, the row selection circuit 15 comprises, for example, a shift register, in which each time a combination of two successive "ones" is shifted by two shift register sites $15^a$. After each shift, the "ones" are written into latches $15^b$ which control corresponding rows in such a manner that a selection voltage $V_{sel}$ is presented. With the exception of the first row, two successive rows 13 are then always provided with a selection voltage in a selection period, and the two subsequent rows are provided with a selection voltage in the subsequent selection period. The same takes place in the subsequent field, but the "ones" in the shift register are then shifted by one shift register site with respect to the first field. In this way, the information of picture line 1 is written into row 1 during writing of the odd field, the information of picture line 3 is written into row 2 as well as into row 3, the information of picture line 5 is written into row 4 as well as into row 5, etc. In the same way, the information of picture line 2 is written into row 1 as well as into row 2 during writing of the even field, the information of picture line 4 is written into row 3 and into row 4, etc. Consequently, the average of the picture lines 1 and 2 is effectively displayed in row 1, the average of the picture lines 2 and 3 is effectively displayed in row 2, etc.

With the exception of row 1, each $n^{th}$ row is more generally provided with drive voltages when two successive fields are being written, which drive voltages are derived from picture information of the $n^{th}$ picture line and of the $(n+1)^{th}$ picture line.

Since the pixels are now selected twice per frame period (=2 field periods), the individual pixels only need to provide half the luminance for obtaining the same average luminance (with respect to time), as compared with the situation in which the pixels are selected only once per frame period. The current density during selection is thus much lower. Although the pixels are now driven at the double frequency, their lifetime is increased. Moreover, when the current density remains the same, the luminance can be approximately doubled.

In summary, the invention relates to driving a display device based on polymer LEDs, for example, of pixels arranged in the form of a matrix having a longer lifetime, because the information from an interlaced signal is always written into two successive rows. The driving device may be based on voltage control as described above, at which voltages across the pixels define the picture to be displayed, including the grey scales, but may also be based on current control, in which the current through the pixels determines the grey scale. In both cases, the grey scales can be determined by means of amplitude modulation or by means of pulse width modulation of the data signal.

Although strips of material emitting different colors of light have been described in this embodiment, it is also possible to use pixels which are realized in one given material emitting one color of light, and in which the surface is coated with a suitable color filter. The invention is of course also applicable to monochrome display devices of this type.

We claim:

1. An electroluminescent device comprising a first pattern of electrodes, a second pattern of electrodes, at least one layer of a semiconducting conjugated polymer interpositioned between the first and second patterns of electrodes, at least one of which electrodes is transparent to light to be emitted from the polymer layer, the first pattern comprised of a material which is suitable for injecting holes or electrons into the polymer layer, characterized in that one of the first and second patterns of electrodes comprises row electrodes and the other pattern comprises column electrodes situated cross-wise with respect to the row electrodes, the areas of crossing defining pixels in the interpositioned polymer layer, and further characterized in that the device comprises a drive circuit for presenting drive voltages representing rows of picture information derived from successive odd and even fields of picture information to the row electrodes, the drive circuit comprising means for presenting drive voltages representing an nth row of picture information from an odd field simultaneously to an nth row electrode and to an adjacent row electrode, and next presenting drive voltages representing an adjacent row of picture information from an even field simultaneously to the an nth row electrode and to an adjacent row electrode, whereby each nth row of pixels is alternately presented with drive voltages representing the nth row of picture information and an adjacent row of picture information.

2. An electroluminescent device as claimed in claim 1, for displaying successive rows of picture information, wherein during two successive field periods, the drive circuit provides an nth row electrode with drive voltages representing the nth row of picture information and the (n+1)th row of picture information.

* * * * *